US007789096B1

(12) United States Patent
Liu

(10) Patent No.: US 7,789,096 B1
(45) Date of Patent: Sep. 7, 2010

(54) FULLY AUTOMATIC COLLAPSIBLE AND MULTI-FOLDABLE UMBRELLA

(75) Inventor: Fu-Tien Liu, P.O. Box 44 - 2049, Taipei (TW) 10668

(73) Assignees: Fu-Tien Liu, Lu-Chou, Taipei; Hsien-Sao Wu, Taipei ( * ) Notice: Subject to any disclaimer, the term of this patent is extended or adjusted under 35 U.S.C. 154(b) by 0 days.

(21) Appl. No.: 12/453,576

(22) Filed: May 15, 2009

(30) Foreign Application Priority Data

Feb. 14, 2009 (CN) ..... 2009 2 0051378 U

(51) Int. Cl.
*A45B 25/14* (2006.01)
*A45B 25/16* (2006.01)
*A45B 19/08* (2006.01)

(52) U.S. Cl. ..... 135/24; 135/20.3; 135/25.4

(58) Field of Classification Search ..... 135/20.3, 135/22, 24, 25.4, 37, 40, 38
See application file for complete search history.

(56) References Cited

U.S. PATENT DOCUMENTS 6,810,894 B2 * 11/2004 Chen ..... 135/22
7,261,112 B2 * 8/2007 Liu ..... 135/28
2005/0257817 A1 * 11/2005 Kuo ..... 135/24

* cited by examiner

*Primary Examiner*—David Dunn
*Assistant Examiner*—Danielle Jackson

(57) ABSTRACT

A fully automatic collapsible and multi-foldable umbrella includes an umbrella rib, an upper nest, a lower nest, a middle rod and a compression spring disposed between the upper and lower nests or a tension spring disposed on the umbrella rib. The middle rod has upper and lower internal plugs. A fastener fastening an external tube of the middle rod is disposed in the upper internal plug so that the middle rod may extend to open the umbrella. The umbrella further includes first and second pull wires. The first pull wire has one end coupled to the lower internal plug and the other end connected to the upper nest after the wire wraps around pulleys on the upper and lower nests. The second pull wire has an upper end connected to the fastener and a lower end connected to a runner on a handle so that the runner drives the fastener.

8 Claims, 10 Drawing Sheets

FULLY AUTOMATIC COLLAPSIBLE AND MULTI-FOLDABLE UMBRELLA

BACKGROUND OF THE INVENTION (1) Field of the Invention

The present invention relates to an umbrella, and more particularly to a fully automatic collapsible and multi-foldable umbrella.

(2) Description of the Prior Art

At present, umbrellas available in the market may be classified into manual umbrellas and automatic umbrellas. Among the automatic umbrellas, a multi-foldable umbrella capable of automatically closing has the following drawbacks. First, the structure is complicated. Second, the umbrella cannot be easily manufactured. Third, the stability of use is poor.

SUMMARY OF THE INVENTION

An object of the present invention is to provide a fully automatic collapsible and multi-foldable umbrella having an improved structure that may be easily manufactured and used.

The invention achieves the above-identified object by adopting the following technical conceptions.

First Conception

A fully automatic collapsible and multi-foldable umbrella includes an umbrella rib, an upper nest, a lower nest, a middle rod and a compression spring, which is disposed between and presses the upper nest and the lower nest, and surrounds the middle rod. The middle rod has an upper internal plug and a lower internal plug disposed inside the middle rod. A fastener is disposed in the upper internal plug, the fastener may partially eject out of the middle rod to fasten an external tube of the middle rod so that the umbrella may be opened. The umbrella further includes a first pull wire and a second pull wire. The first pull wire has one end connected to the lower internal plug of the middle rod and the other end connected to the upper nest after the first pull wire wraps around pulleys on the upper nest and the lower nest. The second pull wire is disposed in the middle rod and has an upper end connected to the fastener in the upper internal plug, and a lower end connected to a runner on a handle so that the runner drives the fastener to close the umbrella.

The fastener is pivotally connected to the upper internal plug, and an internal side of the fastener is supported by a compression spring to have elasticity of projecting out and to fasten the external tube of the middle rod. The fastener is formed with a slanting slide hole, and the upper end of the second pull wire slides in the slide hole to press the fastener down.

The umbrella further includes an elastic member disposed between the upper end of the second pull wire and the upper internal plug to pull the upper end of the second pull wire. The second pull wire has a compartmental structure including an upper-section pull wire and a lower-section pull wire. An upper end of the upper-section pull wire is formed with a hook for hooking the slide hole of the fastener, and a lower end of the upper-section pull wire is formed with a ring movably surrounding the lower-section pull wire. An upper end of the lower-section pull wire is also formed with a ring movably surrounding the upper-section pull wire, and the two rings form an anti-loosening structure.

The lower-section pull wire of the second pull wire is connected to the runner on the handle, and the runner has a ring structure surrounding the middle rod. The runner has a transverse pin shaft connected to the pull wire and penetrating through an axial long slot of the middle rod. A lower side of the pin shaft is supported by a compression spring for providing anti-pressing elasticity for the runner. The compression spring structure is disposed on the middle rod. A lower end of the middle rod is connected to the handle by way of thread connection, rivet connection or screw connection.

The lower end of the lower-section pull wire of the second pull wire may further be connected to a slider inside the middle rod. The slider is movably embedded into the middle rod. The slider is connected to the runner on the handle through a pin shaft. The runner has the ring structure surrounding the middle rod. The pin shaft transversally penetrates through the axial long slot of the middle rod. Two ends of the pin shaft are respectively mounted on the slider and the runner. A lower side of the runner is supported by a compression spring for providing anti-pressing elasticity for the runner. The compression spring is disposed on the middle rod. A lower end of the middle rod is connected to the handle by way of thread connection, rivet connection or screw connection.

The umbrella further includes a soft cover disposed on an end portion of a lower extending section of the lower nest.

Second Conception

A fully automatic collapsible and multi-foldable umbrella includes an umbrella rib, an upper nest, a lower nest, a middle rod, and a tension spring disposed on the umbrella rib, and the tension spring is connected to and disposed between a primary bone and a secondary bone so that the umbrella rib may be automatically retracted. The middle rod has an upper internal plug and a lower internal plug disposed inside the middle rod. A fastener is disposed in the upper internal plug, and the fastener may partially eject out of the middle rod to fasten an external tube of the middle rod so that the umbrella may be opened. The umbrella further includes a first pull wire and a second pull wire. The first pull wire has one end connected to the lower internal plug of the middle rod and the other end connected to the upper nest after the first pull wire wraps around pulleys on the upper nest and the lower nest. The second pull wire is disposed in the middle rod, and has an upper end connected to the fastener in the upper internal plug and a lower end connected to a runner on a handle so that the runner drives the fastener to close the umbrella.

In the above-mentioned conception, the fastener is pivotally connected to the upper internal plug, and an internal side of the fastener is supported by a compression spring to have elasticity of projecting out and to fasten the external tube of the middle rod. The fastener is formed with a slanting slide hole, and the upper end of the second pull wire slides in the slide hole to press the fastener down. An elastic member for pulling the upper end of the second pull wire is disposed between the upper end of the second pull wire and the upper internal plug.

The second pull wire has a compartmental structure including an upper-section pull wire and a lower-section pull wire. An upper end of the upper-section pull wire is formed with a hook for hooking the slide hole of the fastener. A lower end of the upper-section pull wire is formed with a ring movably surrounding the lower-section pull wire. An upper end of the lower-section pull wire is also formed with a ring movably surrounding the upper-section pull wire. The two rings form an anti-loosening structure. The lower-section pull wire of the second pull wire is connected to the runner on the handle. The runner has a ring structure surrounding the middle rod. The runner has a transverse pin shaft connected to the pull wire and penetrating through an axial long slot of the middle rod. A lower side of the pin shaft is supported by a compression spring for providing anti-pressing elasticity for the runner. The compression spring structure is disposed on the middle rod, and a lower end of the middle rod is connected to the handle by way of thread connection, rivet connection or screw connection.

The invention adopts two pull wires in conjunction with the corresponding compression or tension spring to automatically close the umbrella. The first pull wire pulls the lower nest to open the umbrella. The second pull wire pulls the fastener to close the umbrella. The compression or tension spring disposed on the middle rod or the umbrella rib provides the force for closing the umbrella, so the structure is stable, and the umbrella may be used conveniently and manufactured easily.

Further aspects, objects, and desirable features of the invention will be better understood from the detailed description and drawings that follow in which various embodiments of the disclosed invention are illustrated by way of examples.

DETAILED DESCRIPTION OF THE PREFERRED EMBODIMENTS

The present invention will be described with reference to the accompanying drawings.

First Embodiment

Figure 1:
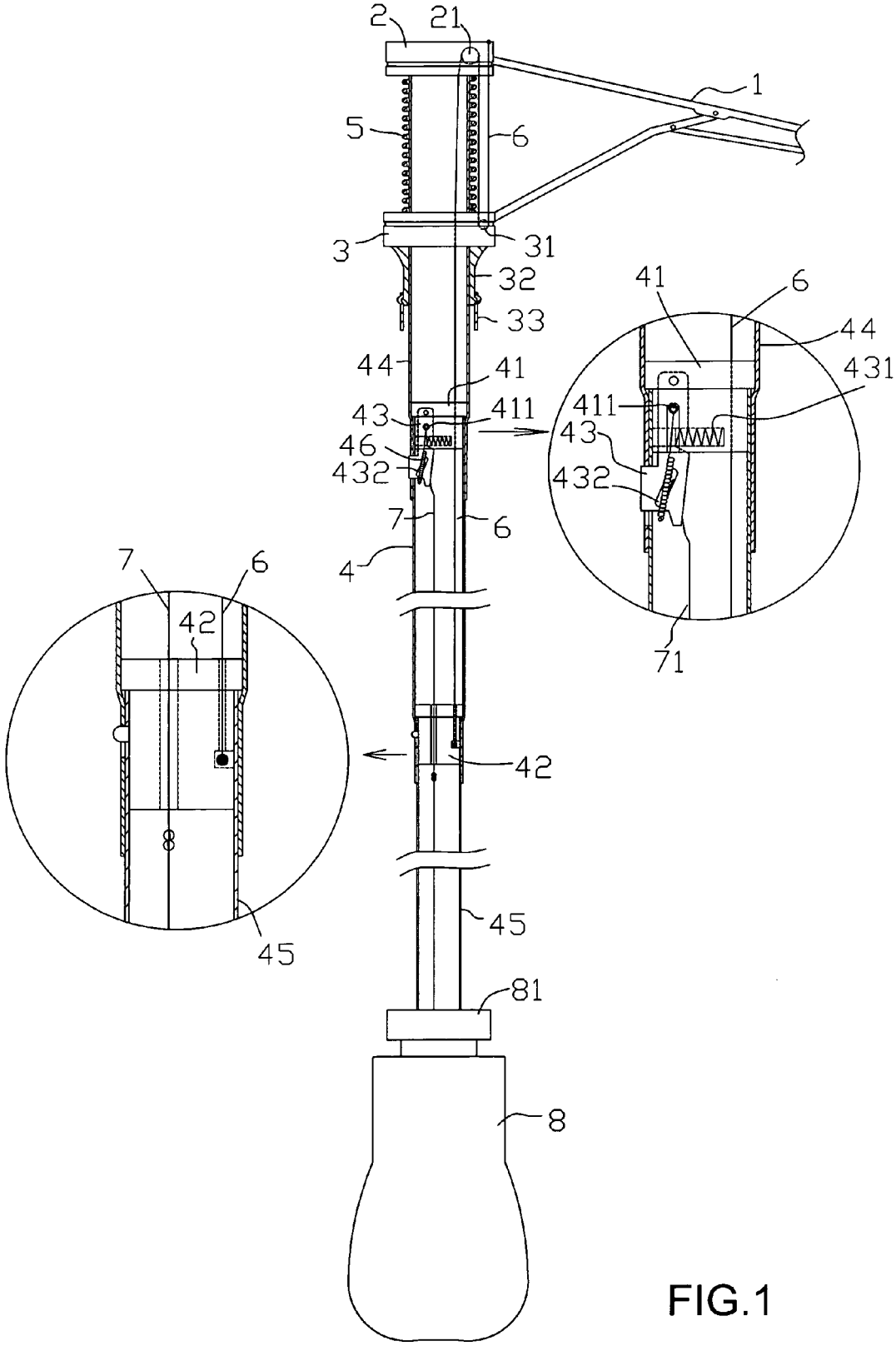
FIG. 1 is a schematic illustration showing an embodied structure of the present invention.
Figure 2:
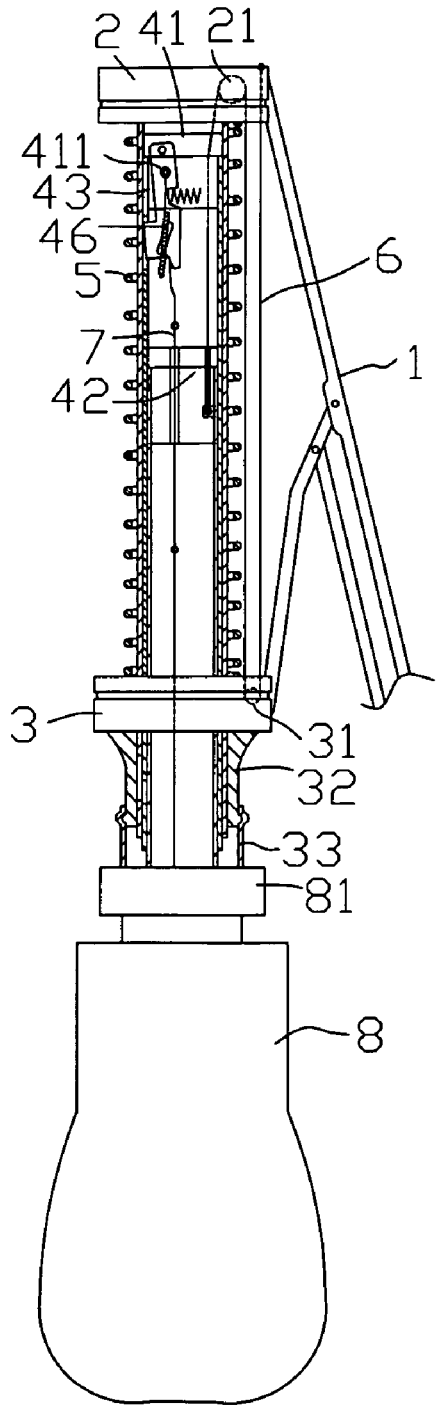
FIG. 2 is a schematic illustration showing the closed umbrella of FIG. 1.

Referring to FIGS. 1 and 2, an umbrella of the present invention includes an umbrella rib 1, an upper nest 2, a lower nest 3, and a middle rod 4 being a multi-section tube having an upper external tube connected to the upper nest 2. The middle rod 4 has an upper internal plug 41 and a lower internal plug 42 disposed inside the middle rod 4. A compression spring 5 surrounds the middle rod 4 and is disposed between the upper nest 2 and the lower nest 3 to provide the force for automatically closing the umbrella. A first pull wire 6 has one end connected to the lower internal plug 42 of the middle rod and the other end connected to the upper nest after the first pull wire wraps around the pulley(s) 21 on the upper nest and the pulley(s) 31 on the lower nest. In this embodiment, the first pull wire is a pull rope, and two ends of the first pull wire are respectively fixed to the lower internal plug 42 and the upper nest 2 by way of knotting. The numbers of the pulley(s) on the upper nest and the lower nest may be determined according to the wrapping condition of the first pull wire 6. At least one pulley is disposed on each of the upper nest and the lower nest.

A fastener 43 is disposed in the upper internal plug 41. The fastener may partially eject out of the middle rod to fasten the external tube of the middle rod so that the umbrella may be opened. A second pull wire 7 disposed within the middle rod has an upper end connected to the fastener 43, and a lower end connected to a runner 81 of a handle 8 so that the runner can drive the fastener to close the umbrella.

As shown in FIG. 1, when the umbrella is to be opened, one hand of the user grips the handle and the other hand of the user pushes the lower nest 3 upwards so that the umbrella rib 1 is opened and the middle rod 4 is extended or lengthened until the fastener 43 in the middle rod ejects out to fasten an external tube 44 of the middle rod. That is, the extending of the middle rod is stabilized, and the extending of the internal, middle and external tubes is fixed. Meanwhile, the lower internal plug 42 in the internal tube pulls the lower end of the first pull wire 6, and the other end of the first pull wire 6 pulls the lower nest 3 through the pulley 21 on the upper nest and the pulley 31 on the lower nest so that the lower nest 3 is shifted upward to a predetermined position and cannot slide down and the opened-state is thus reached. The compression spring 5 is in a compressed state to store the energy. The second pull wire 7 is pulled to the longest length with the extending of the middle rod 4 so that the tight state is reached and the runner 81 can drive the fastener 43.

Figure 11:
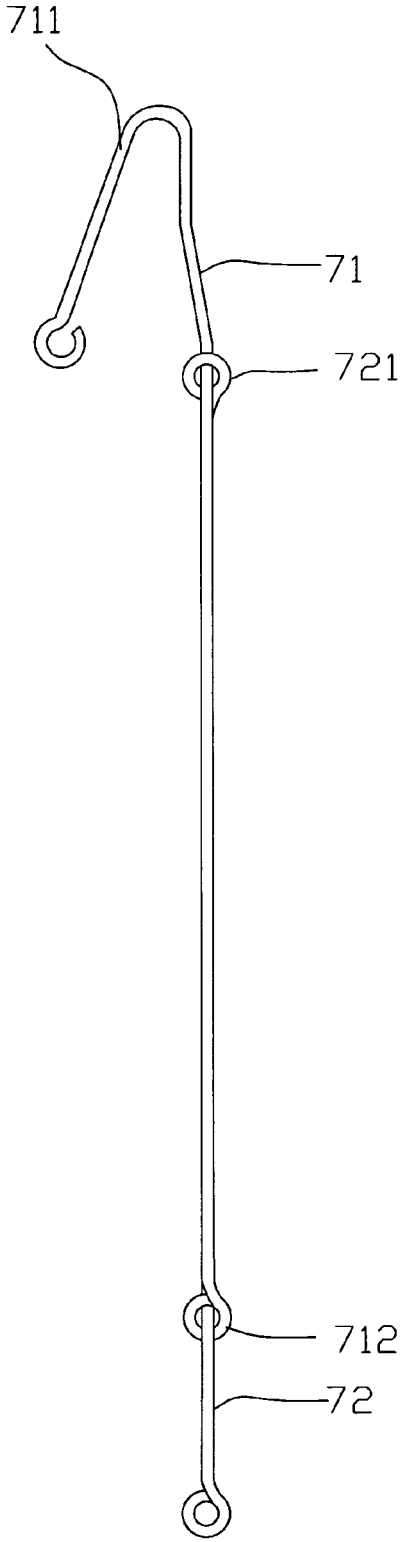
FIG. 11 is a schematic illustration showing the retracted second pull wire.

As shown in FIG. 2, when the umbrella is to be closed, the runner 81 on the handle 8 is pulled down to drive the fastener 43 to retract inwards through the second pull wire 7 so that the external tube 44 of the middle rod is loosened. Under the action of the compression spring 5, the lower nest 3 is relatively shifted downwards. When the lower nest 3 is shifted downwards, it pulls the first pull wire 6 so that the lower end of the first pull wire 6 pulls the lower internal plug 42 and the internal tube 45 of the middle rod (the lower internal plug 42 is fixed in the internal tube 45), other tubes are driven to retract toward the external tube 44, and the internal tube 45 of the middle rod and the positioning fasteners of the other tubes automatically retract. Thus, the middle rod is retracted, and the lower nest 3 is shifted downwards to fold the umbrella rib 1 and the umbrella can be automatically closed. When the middle rod retracts, the second pull wire 7 is loosened and accommodated within the middle rod. When the second pull wire 7 is a pull rope, the second pull wire 7 is loosely accommodated within the middle rod. When the second pull wire 7 has the compartmental structure, as shown in FIG. 11, an upper-section pull wire 71 and a lower-section pull wire 72 slide on each other respectively through rings 712 and 721 thereof so that the upper-section pull wire 71 and the lower-section pull wire 72 partially overlap with each other. Thus, the second pull wire 7 can be shortened in conjunction with the retraction of the middle rod.

Second Embodiment

Figure 3:
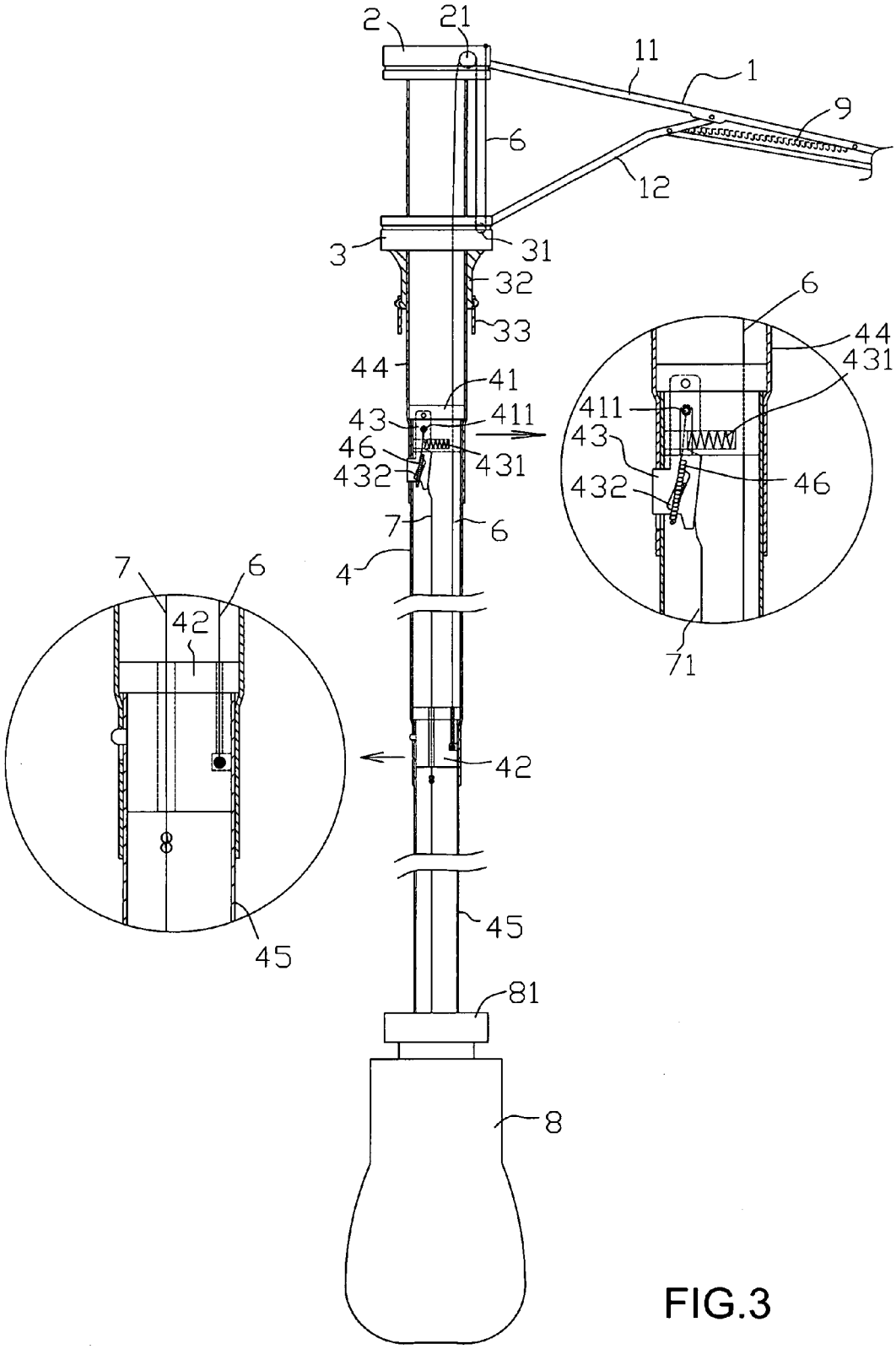
FIG. 3 is a schematic illustration showing two embodied structures of the present invention.
Figure 4:
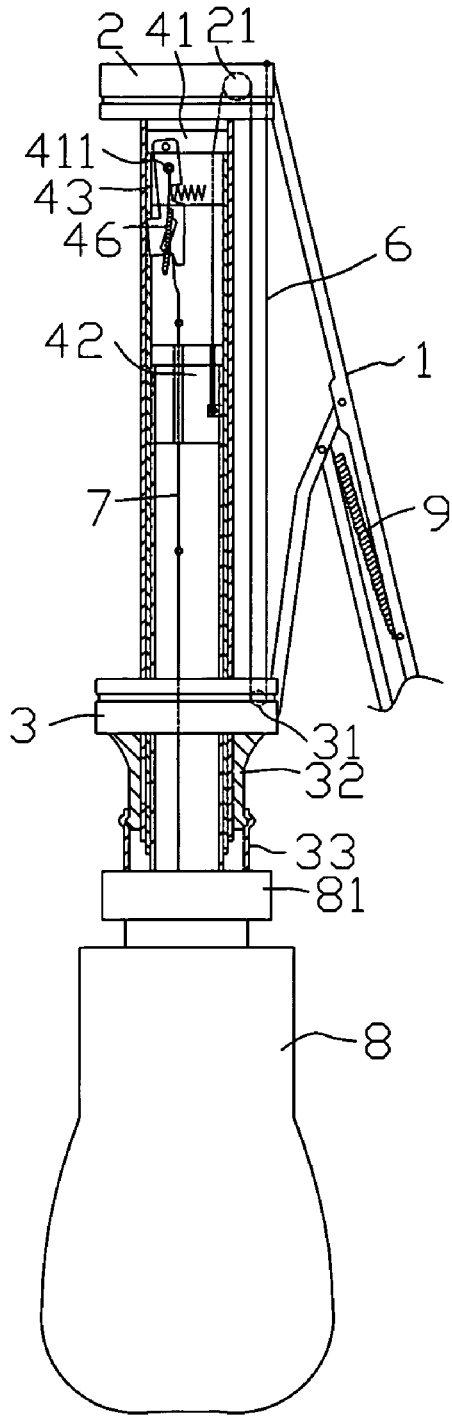
FIG. 4 is a schematic illustration showing the closed umbrella of FIG. 3.

Referring to FIGS. 3 and 4, the umbrella of the present invention includes an umbrella rib 1, an upper nest 2, a lower nest 3 and a middle rod 4. The middle rod 4 is a multi-section tube having an upper external tube connected to the upper nest 2. The middle rod has an upper internal plug 41 and a lower internal plug 42. A fastener 43 is disposed in the upper internal plug 41 and may partially eject out of the middle rod to fasten the external tube of the middle rod so that the umbrella can be opened. The umbrella further includes a tension spring 9 disposed on the umbrella rib. The tension spring 9 is connected to and disposed between a primary bone 11 and a secondary bone 12 to provide the force for automatically closing the umbrella. One end of a first pull wire 6 is connected to the lower internal plug 42, which is fixed in an internal tube 45. The first pull wire is a pull rope having a lower end fixed to the lower internal plug 42 by way of knotting. The internal plug 42 and the internal tube 45 are relatively stationary so that the first pull wire 6 correspondingly pulls the internal tube 45. The other end of the first pull wire 6 is connected to the upper nest after the first pull wire 6 wraps around the pulley(s) 21 on the upper nest and the pulley(s) 31 on the lower nest and is similarly fixed to the upper nest by way of knotting. The numbers of the pulley(s) on the upper nest and the lower nest may be determined according to the wrapping condition of the first pull wire 6. At least one pulley is disposed on each of the upper nest and the lower nest. A second pull wire 7 is disposed in the middle rod and has an upper end connected to the fastener 43 on the middle rod. The fastener 43 fastens an external tube 44 of the middle rod so that the middle rod is extended and the umbrella is opened. The lower end of the second pull wire is connected to a runner 81 on a handle 8 so that the runner drives the fastener to close the umbrella.

As shown in FIG. 3, when the umbrella is to be opened, one end of the user grips the handle and the other hand of the user pushes the lower nest 3 upwards so that the umbrella rib 1 is opened and the middle rod 4 is extended until the fastener 43 in the middle rod ejects out to fasten the external tube 44 of the middle rod. That is, the extending of the middle rod is stabilized, and the extending of the internal, middle and external tubes is fixed. Meanwhile, the lower internal plug 42 in the internal tube pulls the lower end of the first pull wire 6, and the other hand of the first pull wire 6 pulls the lower nest 3 through the pulley 21 on the upper nest and the pulley 31 on the lower nest so that the lower nest 3 cannot slide down after being shifted upward to the predetermined position, and the open state of the umbrella is reached. The tension spring 9 between the primary bone 11 and the secondary bone 12 is in a tensile state to store the energy. The second pull wire 7 is pulled to the longest length with the lengthening of the middle rod 4 and enters the tight state so that the runner 81 can drive the fastener 43.

As shown in FIG. 4, when the umbrella is to be closed, the user has to press the runner 81 on the handle 8, and the second pull wire 7 drives the fastener 43 to retract inward so that the external tube 44 of the middle rod is loosened. Under the action of the tension spring 9, the umbrella rib 1 is folded and the lower nest 3 is pushed relatively downwards. When the lower nest 3 is pushed downwards, the first pull wire 6 is pulled so that the lower end of the first pull wire 6 pulls up the middle rod internal tube 45 and other tubes are driven to retract toward the external tube 44, and the internal tube 45 of the middle rod and the positioning fasteners of the other tubes automatically retract. Thus, the middle rod is retracted and the umbrella can be automatically closed. When the middle rod retracts, the second pull wire 7 is loosely accommodated within the middle rod. When the second pull wire 7 is a pull rope, the second pull wire 7 is loosely accommodated within the middle rod. When the second pull wire 7 has the compartmental structure including an upper-section pull wire 71 and a lower-section pull wire 72, as shown in FIG. 11, wherein the upper-section pull wire 71 and the lower-section pull wire 72 slide on each other respectively through rings 712 and 721 thereof so that the upper-section pull wire 71 and the lower-section pull wire 72 partially overlap with each other. Thus, the second pull wire 7 cab be shortened in conjunction with the retraction of the middle rod.

Figure 7A:
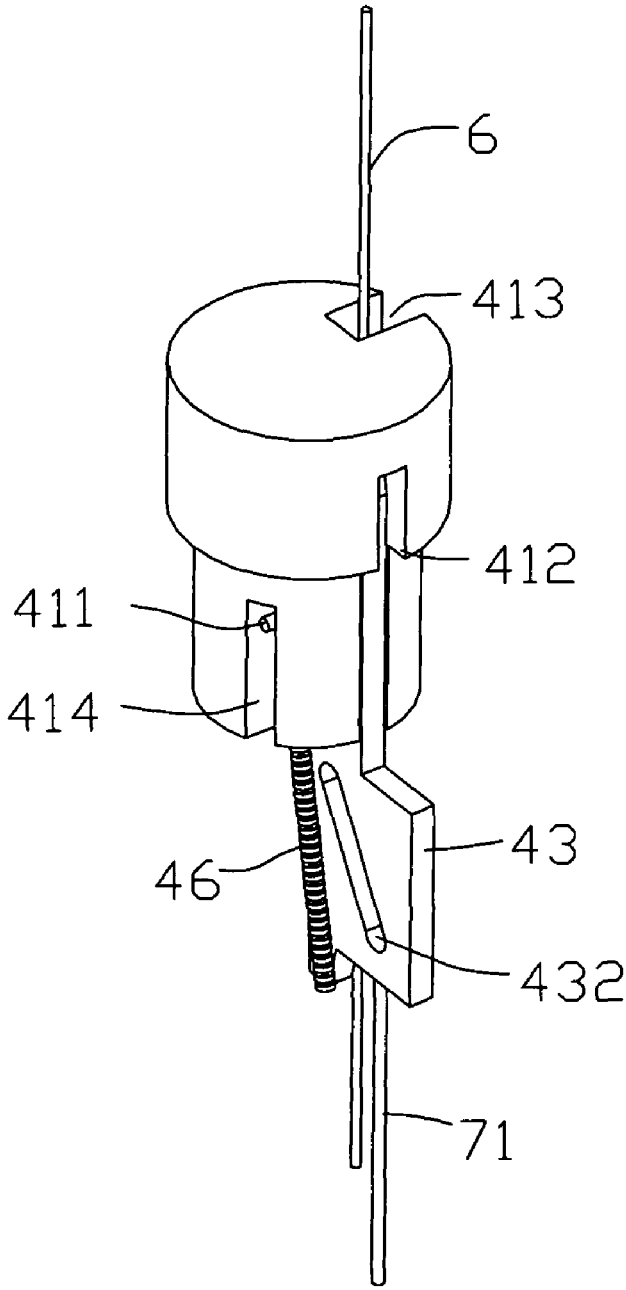
FIG. 7*a* is a schematic illustration showing the structure of an upper internal plug.
Figure 7B:
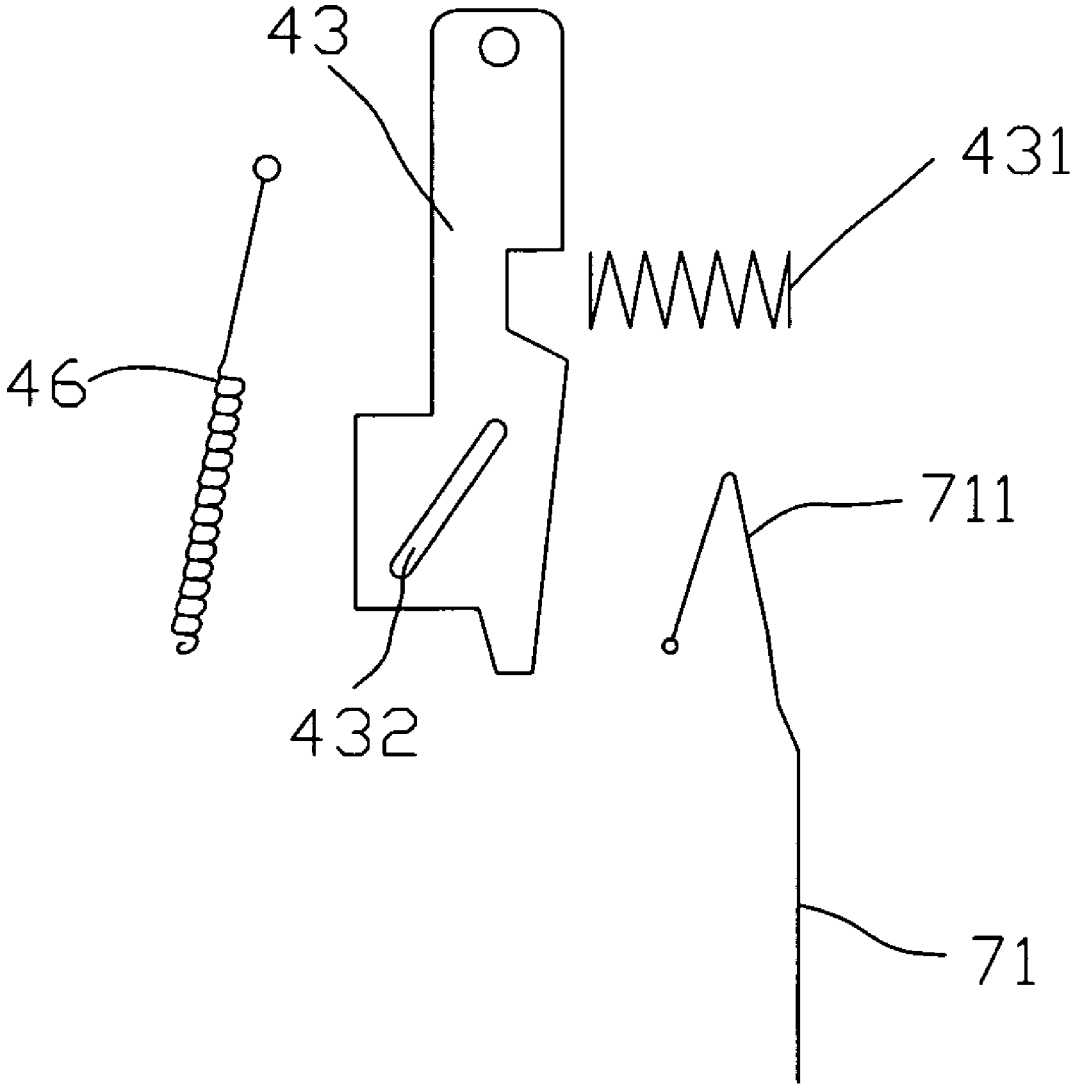
FIG. 7*b* is a schematic illustration showing the structure of a fastener.

As shown in FIGS. 1 to 4 and 7*a* and 7*b*, the fastener 43 is pivotally connected to the upper internal plug 41, and the internal side of the fastener 43 is supported by a compression spring 431 to have the elasticity of projecting out and to fasten the external tube of the middle rod. A slanting slide hole 432 is formed on the fastener, and the upper end of the second pull wire slides in the slide hole to press the fastener down. As shown in FIG. 7*a*, the upper internal plug 41 is formed with a corresponding notch 412 so that the fastener 43 may be placed into and pivotally connected to the upper internal plug. The notch 412 also provides a space for the fastener 43 to swing. A through slot 413 for accommodating the first pull wire 6 penetrating through the upper internal plug 41 and an accommodating slot 414 for the mounting of an elastic member 46 are further formed on the external side surface of the upper internal plug 41. The elastic member 46 is connected to and disposed between the upper end of the second pull wire and the upper internal plug 41. In this embodiment, the elastic member 46 is a tension spring having one end fixed to a projecting post 411 of the upper internal plug. The projecting post 411 is disposed within the accommodating slot 414, and the other end of the tension spring 46 is fixed to the upper end of the second pull wire to properly pull the upper end of the second pull wire and thus to provide the stronger restoring force. That is, when the fastener 43 projects out, the compression spring 431 on the internal side of the fastener 43 pushes the fastener 43 to project out and properly pull up the second pull wire. On the other hand, the tension spring 46 directly pulls up the second pull wire so that the restoring becomes better and the fastener 43 may be retracted and pressed in the next time.

Figure 8A:
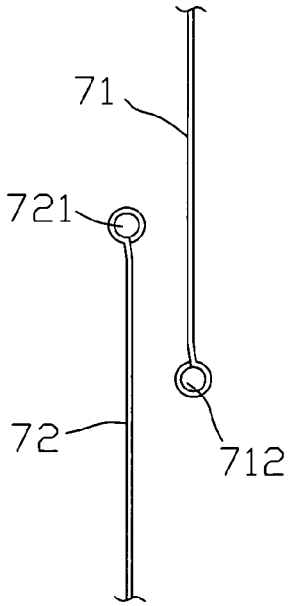
FIGS. 8*a* and 8*b* are schematic illustrations showing internal connection structures of the second pull wire of the present invention.
Figure 8B:
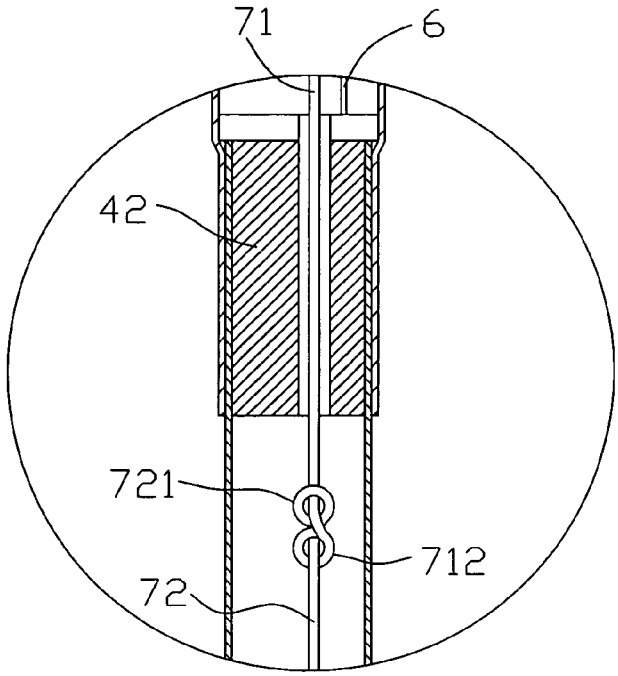
Figure 9:
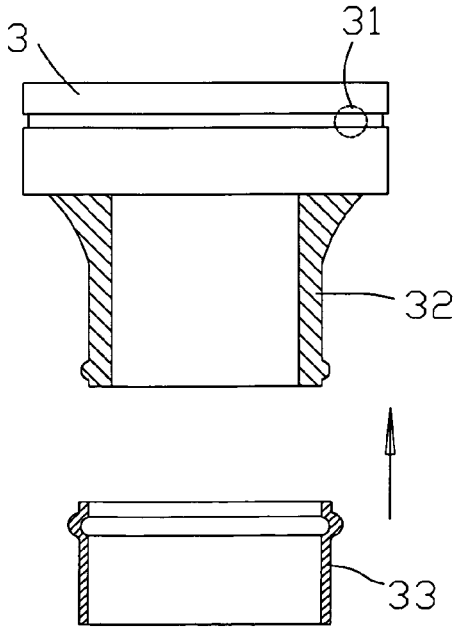
FIG. 9 is a schematic illustration showing the connection of a soft cover and a lower nest.

The slanting slide hole 432 is formed on the fastener. When the upper end of the second pull wire 7 slides in the slide hole, an action force is generated to press down the fastener 43 so that the fastener 43 retracts inwards, the fastening may be released and the umbrella may be closed. As shown in FIGS. 1 to 4 and 8*a* and 8*b*, the second pull wire is a metal wire having the compartmental structure, the upper end of the upper-section pull wire 71 is formed with a hook 711 for hooking the slide hole 432 on the fastener. The lower end of the upper-section pull wire is formed with a ring 712 movably surrounding the lower-section pull wire 72. The upper end of the lower-section pull wire is also formed with a ring 721 movably surrounding the upper-section pull wire. The two rings form the anti-loosening structure but may slide relatively to the surrounded pull wires. In practice, the lower-section pull wire may be a pull rope. As shown in FIGS. 8*a* and 8*b*, when the middle rod retracts, the two rings slide away in conjunction with the shortening of the middle rod; and when the middle rod extends, the two rings approach each other to form the anti-loosening state and thus pull the second pull wire to become straight in order to drive the fastener 43.

Figure 5:
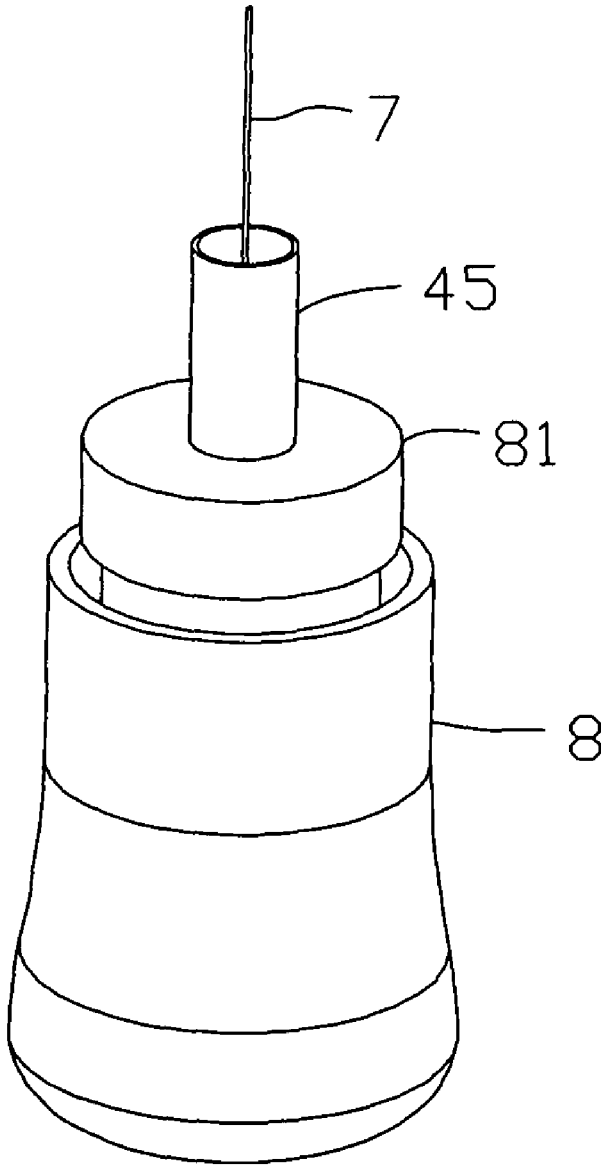
FIG. 5 is a schematic illustration showing a partially stereoscopic structure of a handle.
Figure 6:
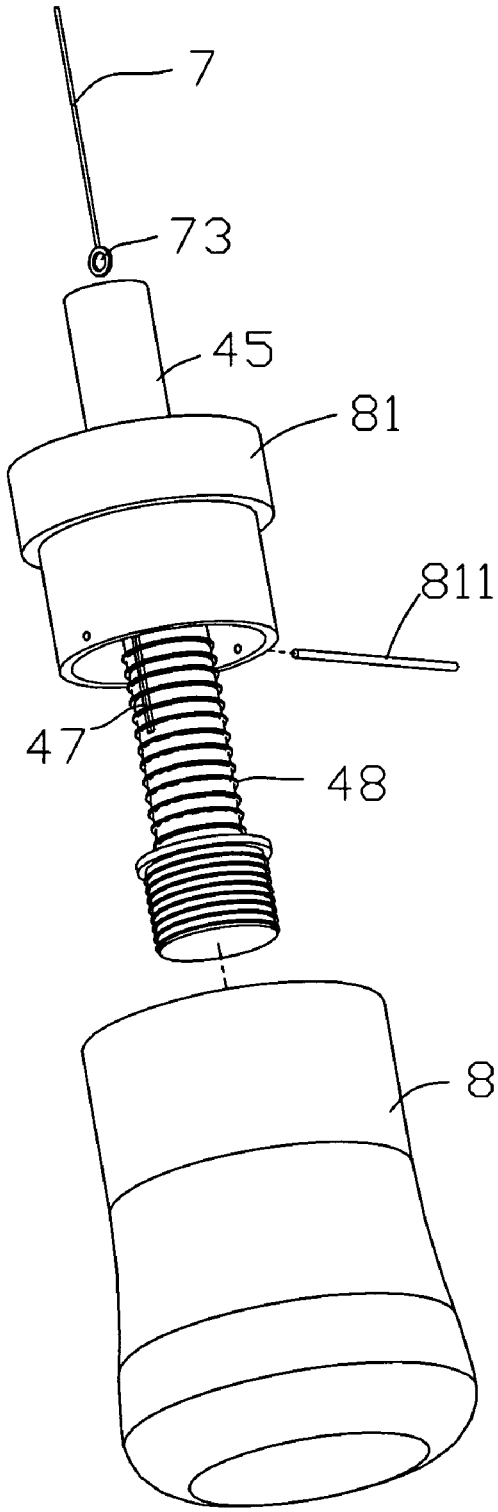
FIG. 6 is a decomposed schematic illustration showing the partially stereoscopic structure of the handle.

As shown in FIGS. 5 and 6, the lowest-section pull wire of the second pull wire 7 is connected to the runner 81 on the handle 8, and the runner has a ring structure surrounding the internal tube 45 of the middle rod. The runner 81 has a transverse pin shaft 811 connected to the pull wire, and the pull wire connection portion is formed with a ring hole 73 through which the pin shaft 811 may penetrate for the connection. The pin shaft 811 penetrates through an axial long slot 47 of the middle rod. The long slot 47 penetrates through left and right sides of the internal tube. A compression spring 48 supporting the lower side of the pin shaft 811 provides the runner 81 the anti-pressing elasticity. The compression spring 48 surrounds the internal tube of the middle rod, and the lower end of the middle rod is connected to the handle 8 by way of thread connection, rivet connection or screw connection. In this embodiment, the thread connection is adopted. In use, the runner 81 is pressed down, and the runner 81 slides down along the internal tube of the middle rod. The upper end of the handle 8 has the sufficient space in which the runner 81 may work. When the runner 81 slides down, the second pull wire 7 is pulled down through the pin shaft 811 so that the fastener 43 on the middle rod may be driven. The axial long slot 47 of the middle rod provides a sliding space for the pin shaft 811, and the compression spring 48 provides the restoring force for the runner 81.

Figure 10:
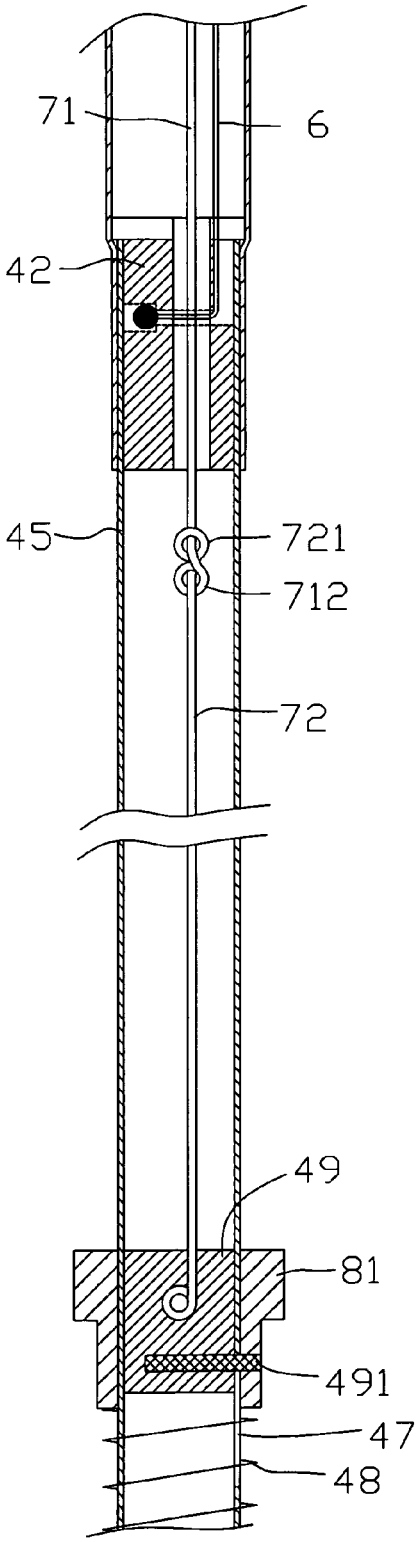
FIG. 10 is a schematic illustration showing another embodiment of a runner.

As shown in FIG. 10, the runner 81 may also be implemented according to the following aspects. At this time, the lower end of the lower-section pull wire 72 of the second pull wire is connected to a slider 49 inside the middle rod, and the slider 49 is movably embedded into the middle rod. The slider 49 is connected to the runner 81 on the handle through a pin shaft 491 so that the slider 49 and the runner 81 may be moved simultaneously. The runner 81 has a ring structure surrounding the middle rod. The pin shaft 491 transversally penetrates through the axial long slot 47 of the middle rod. At this time, the long slot 47 only needs to have the single open side to assure the structure intensity of the middle rod. Two ends of the pin shaft 491 are respectively mounted on the slider 49 and the runner 81. The lower side of the runner 81 is supported by the compression spring 48, which provides the anti-pressing elasticity for the runner. The compression spring 48 surrounds the middle rod, and the lower end of the middle rod is connected to the handle 8 by way of thread connection, rivet connection or screw connection. In this embodiment, the thread connection is adopted. In use, the runner 81 is pressed down, and the runner 81 slides down along the internal tube of the middle rod. The upper end of the handle 8 has the sufficient space in which the runner 81 may work. When the runner 81 slides down, the slider 49 is jointly moved through the pin shaft 491 so that the second pull wire 7 is pulled down and the fastener 43 on the middle rod may be driven. The axial long slot 47 of the middle rod provides the sliding space for the pin shaft 491, and the compression spring 48 provides the restoring force for the runner 81.

As shown in FIGS. 1 to 4 and 9, a soft cover 33 is disposed on the end portion of a lower extending section 32 of the lower nest, and the soft cover 33 covers the end portion to provide the flexibility. Thus, it is possible to prevent the lower nest, which is sliding down, from impacting the user and thus to enhance the safety.

New characteristics and advantages of the invention covered by this document have been set forth in the foregoing description. It is to be expressly understood, however, that the drawings are for the purpose of illustration only and are not intended as a definition of the limits of the invention. Changes in methods, shapes, structures or devices may be made in details without exceeding the scope of the invention by those who are skilled in the art. The scope of the invention is, of course, defined in the language in which the appended claims are expressed.

What is claimed is:

1. A fully automatic collapsible and multi-foldable umbrella, comprising an umbrella rib, an upper nest, a lower nest, a middle rod and a compression spring, which is disposed between and presses the upper nest and the lower nest, and surrounds the middle rod, characterized in that:

the middle rod has an upper internal plug and a lower internal plug disposed inside the middle rod, a fastener is pivotally connected to the upper internal plug, an internal side of the fastener is supported by the compression spring to have elasticity to partially project out of the middle rod and to fasten an external tube of the middle rod, so that the umbrella is opened, the fastener is formed with a slanting slide hole, and the umbrella further comprises:

a first pull wire having one end connected to the lower internal plug of the middle rod and the other end connected to the upper nest after the first pull wire wraps around pulleys on the upper nest and the lower nest; and a second pull wire, which is disposed in the middle rod, and has an upper end connected to the fastener in the upper internal plug and a lower end connected to a runner on a handle, the upper end of the second pull wire slides in the slide hole to press the fastener down so that the runner drives the fastener to close the umbrella.

2. The umbrella according to claim 1, further comprising an elastic member disposed between the upper end of the second pull wire and the upper internal plug to pull the upper end of the second pull wire.

3. The umbrella according to claim 2, wherein the second pull wire has a compartmental structure comprising an upper-section pull wire and a lower-section pull wire, an upper end of the upper-section pull wire is formed with a hook for hooking the slide hole of the fastener, a lower end of the upper-section pull wire is formed with a ring movably surrounding the lower-section pull wire, an upper end of the lower-section pull wire is also formed with a ring movably surrounding the upper-section pull wire, and the two rings form an anti-loosening structure.

4. The umbrella according to claim 1, wherein the second pull wire has a compartmental structure comprising an upper-section pull wire and a lower-section pull wire, an upper end of the upper-section pull wire is formed with a hook for hooking a slide hole of the fastener, a lower end of the upper-section pull wire is formed with a ring movably surrounding the lower-section pull wire, an upper end of the lower-section pull wire is also formed with a ring movably surrounding the upper-section pull wire, and the two rings form an anti-loosening structure.

5. The umbrella according to claim 4, wherein the lower-section pull wire of the second pull wire is connected to the runner on the handle, the runner has a ring structure surrounding the middle rod, the runner has a transverse pin shaft connected to the pull wire and penetrating through an axial long slot of the middle rod, a lower side of the pin shaft is supported by a compression spring for providing anti-pressing elasticity for the runner, the compression spring structure is disposed on the middle rod, and a lower end of the middle rod is connected to the handle by way of thread connection, rivet connection or screw connection.

6. The umbrella according to claim 4, wherein the lower end of the lower-section pull wire of the second pull wire is connected to a slider inside the middle rod, the slider is movably embedded into the middle rod, the slider is connected to the runner on the handle through a pin shaft, the runner has a ring structure surrounding the middle rod, the pin shaft transversally penetrates through an axial long slot of the middle rod, two ends of the pin shaft are respectively mounted on the slider and the runner, a lower side of the runner is supported by a compression spring for providing anti-pressing elasticity for the runner, the compression spring is disposed on the middle rod, and a lower end of the middle rod is connected to the handle by way of thread connection, rivet connection or screw connection.

7. The umbrella according to claim 1, wherein the second pull wire has a compartmental structure comprising an upper-section pull wire and a lower-section pull wire, an upper end of the upper-section pull wire is formed with a hook for hooking the slide hole of the fastener, a lower end of the upper-section pull wire is formed with a ring movably surrounding the lower-section pull wire, an upper end of the lower-section pull wire is also formed with a ring movably surrounding the upper-section pull wire, and the two rings form an anti-loosening structure.

8. The umbrella according to claim 1, further comprising a soft cover disposed on an end portion of a lower extending section of the lower nest.

* * * * *